US005726241A

United States Patent [19]

Maruyama et al.

[11] Patent Number: 5,726,241

[45] Date of Patent: Mar. 10, 1998

[54] FINISHING OIL FOR PRECURSOR FOR HIGH PERFORMANCE CARBON FIBERS AND PRECURSOR

[75] Inventors: Kunio Maruyama, Okayama; Ryuichi Koide, Nara-Ken, both of Japan

[73] Assignee: Hexcel Corporation, Pleasanton, Calif.

[21] Appl. No.: 715,098

[22] Filed: Sep. 17, 1996

Related U.S. Application Data

[63] Continuation of Ser. No. 477,627, Jun. 7, 1995, abandoned, which is a continuation of Ser. No. 182,825, Jan. 19, 1994, abandoned.

[51] Int. Cl.[6] ..... C08L 83/00

[52] U.S. Cl. ..... 524/837; 524/864; 106/287.11; 252/8.6; 252/8.8; 252/312; 252/314

[58] Field of Search ..... 252/8.6, 8.8, 312, 252/314; 524/837, 864; 106/287.11

[56] References Cited

U.S. PATENT DOCUMENTS

| | | | |
|---|---|---|---|
| 4,366,001 | 12/1982 | Ona et al. | 106/287.11 |
| 4,663,200 | 5/1987 | Nomura et al. | 106/287.11 |
| 4,999,398 | 3/1991 | Graiver et al. | 524/837 |
| 5,244,598 | 9/1993 | Merrifield et al. | 106/287.11 |

FOREIGN PATENT DOCUMENTS

| | | |
|---|---|---|
| 2-91224 | 3/1990 | Japan . |
| 2-91225 | 3/1990 | Japan . |
| 2-91226 | 3/1990 | Japan . |

*Primary Examiner*—Melvyn I. Marquis
*Assistant Examiner*—Karen A. Dean
*Attorney, Agent, or Firm*—Oppenheimer Poms Smith

[57] ABSTRACT

A finish composition for a precursor for high-performance carbon fibers, containing (1) 0.2–10 parts by weight of an aminocarboxylic material selected from the group consisting of carboxylic acid salts of alkylamines, carboxylic acid salts of arylamines, carboxylic acid salts of alkylarylamines, amino acids and betaine compounds, and (2) 100 parts by weight of a mixture of (a) 80–20 parts by weight of a finish prepared by adding, to (i) a silicone finish containing 50 wt % or more of an amino-modified polysiloxane having a nitrogen content in amino groups in the range of 0.05–2.0 wt % and a viscosity at 25° C. of 500 centistokes or more, (ii) 0.3–5.0 molar equivalents of a lower aliphatic monocarboxylic acid of 6 carbon atoms or less with respect to 1 mole of the amino group, and (b) 20–80 parts by weight of a nonionic emulsifier consisting mainly of a polyoxyethylene alkyl ether, a polyoxyethylene alkylaryl ether or a polyoxyethylene fatty acid ester. The finish composition prevents aging of a precursor during its preservation. Also provided is an acrylonitrile precursor for high-performance carbon fibers on which the finish composition is deposited.

7 Claims, No Drawings

FINISHING OIL FOR PRECURSOR FOR HIGH PERFORMANCE CARBON FIBERS AND PRECURSOR

This is a continuation of application Ser. No. 08/477,627 filed on Jun. 7, 1995 now abandoned which is a continuation of Ser. No. 08/182,825 filed on Jan. 19, 1994, now abandoned.

The present invention relates to a finishing oil used on acrylonitrile precursor fibers (hereunder referred to as "precursors") which is necessary as a material for the production of high-performance, i.e., high-strength, high-tensile modulus carbon fibers, and to a precursor on which the finishing oil is deposited.

DESCRIPTION OF THE PRIOR ART

Carbon fibers are produced industrially by the conversion of their precursor fibers, acrylic, rayon, polyvinyl alcohol, novolak or other types of organic fibers, or pitch or other types of inorganic fibers, into oxidized fibers in an oxidizing atmosphere heated to 200°–300° C., followed by carbonization in an inert atmosphere. These steps of oxidation and carbonization are carried out at high temperatures, and consequently the fibers bond or fuse to each other, causing a considerable reduction in the quality of the resultant carbon fibers.

In order to prevent this, various methods have been proposed in which special organic silicone-type finishes (generally called silicone finishes) are used.

Of these, particularly effective in the production of carbon fibers is amino-modified polysiloxane (also called amino-modified silicone or polyaminosiloxane), described in Japanese Patent Publication No. 24136/77, as well as in Japanese Patent Publication No. 10175/78, Japanese Patent Publication No. 52208/85, Japanese Patent Publication No. 23285/88, etc. Also, proposals regarding methods for increasing the stability of finishes by the addition of additives to amino-modified silicone finishes are found in Japanese Patent Kokai (Laid-open) No. 91224/90, Japanese Patent Kokai (Laid-open) No. 91225/90, Japanese Patent Kokai (Laid-open) No. 91226/90, etc.

We the present inventors have also conducted research on precursors for high-performance carbon fibers, and have found that the suitability of a finish for a given precursor greatly influences the performance of the carbon fibers which are formed, and that an amino-modified polysiloxane finish is essential to obtain high-performance carbon fibers. Particularly, with the considerable demand in recent years for high-performance carbon fibers and graphite fibers with high strength and a high tensile modulus, the selection of the finish is judged to be extremely important.

SUMMARY OF THE INVENTION

Thus, amino-modified polysiloxane finishes are very useful, but when precursors on which these finishes are deposited are kept for long periods of time, aging has been found to occur. Particularly, in the production of ultra high-strength carbon fibers, such precursors exhibit remarkable aging when used, and if baking is effected after preservation for 3 months in a warehouse at 30°–40° C. in the summer, the strength of the resulting carbon fibers is reduced by 10% or more, and thus clearly in some cases they cannot be used as precursors for high-performance carbon fibers.

Documents of the prior art make absolutely no mention regarding the aging of acrylic precursors. Here, we have carried out diligent research for investigation of the aging phenomenon thereof, by extracting the finish of the precursor, and noting both the changes in the precursor itself and the changes in the extracted finish.

First, in order to pinpoint the changes in the precursor itself, a chemical analysis and a comparative study on the physical and mechanical properties were made regarding both freshly prepared precursors from which the amino-modified polysiloxane had been removed and precursors which had been aged by preservation for one year at normal temperature (in a storehouse with no temperature control), but no difference was found between the two cases. Here, further study was made regarding the changes in the finish.

Polysiloxane finishes have long been known to undergo gelation upon heating. To prevent this, there is a well-known method of adding an antioxidant or the like to the polysiloxane. Further, reports have been published about the behavior of the thermal cracking of polysiloxanes when an antioxidant is added thereto (for example, see Zh. Prikl. Khim. Vol. 49, No. 4, p. 339–844, 1976).

Considering the fact that the silicone finish is not completely extracted from the precursor on which the silicon finish has been deposited even if the extraction is effected using methyl ethyl ketone (hereunder abbreviated to MEK), the present inventors assumed this to be the cause of gelation of the finish, and tried a method for gelation prevention by the addition of an antioxidant or the use of an emulsifier having a strong acidic group in combination with the finish.

However, this method not only produced no effect against the aging of the precursor, but it was also discovered that it produced the reverse effect of acceleration of the aging.

When the finish extracted from the above mentioned precursor was analyzed using gel chromatography (GPC), is was found that a silicon finish extracted from the precursor which has been preserved for a long period of time contains cyclic siloxane oligomers (of 4–8 units), and those which had been preserved at a higher temperature have more content of such oligomers.

Here, the cause of this phenomenon was assumed to be the gradual degradation of the polysiloxane deposited on the precursor to lower molecular compounds during the preservation, and various experiments were conducted. That is, using various compositions of the emulsifier for emulsification of the amino-modified polysiloxane in water and various types of acids added to accelerate the emulsification, the emulsifying properties, the degree of gelation upon heating, and the conditions of the production of oligomers were investigated in detail.

As a result, it was shown that the degradation of a polysiloxane to lower molecular compounds is rapidly promoted when a strong acidic group such as sulfuric acid, nitric acid, phosphoric acid, sulfonic acid or the like (including not only strongly acidic free acids but also salts and esters thereof) is copresent therewith.

On the other hand, since polyaminosiloxane contains basic amino groups in its molecule, when an emulsifier containing a strong acidic group is used the water solubility is improved, and therefore sulfonic esters and phosphoric esters have been advantageously used as emulsifiers (Japanese Patent Publication No. 24136/77).

Although the use of an emulsifier containing such a strong acidic group, and the incorporation of an antioxidant therein, improves the gelation of polyaminosiloxane, the fact that the degradation thereof to lower molecular compounds is accelerated has been made clear from pyrolysis gas chromatography studies thereof.

In other words, it has been confirmed that when a sulfonic ester or phosphoric ester of polyoxyethylene (hereunder abbreviated to POE) lauryl phenyl ether is added to high molecular polyaminosiloxane and the mixture heated, cyclic siloxane oligomers (of 4–8 units) are readily produced. This degradation to lower molecular compounds is not only unpreventable even with the addition of an antioxidant, but depending on the type of antioxidant, is sometimes even accelerated. Furthermore, even when a small amount of phosphoric was added to POE nonylphenol ether which has no strong acidic group, the production of siloxane oligomers was considerably accelerated.

When a fresh precursor which is produced using an amino-modified polysiloxane finish and which has been oxidized, and a precursor which has been aged by long-term preservation and then oxidized are extracted with MEK, there is little silicon finish extracted by the MEK in the former case, while a large amount of silicon finish is extracted in the latter case. This leads to the suspicion that, when a preserved precursor is exposed to high temperatures for oxidation, there is produced an intermediate structure which inhibits the reaction which makes the silicone finish insoluble in MEK, i.e., the gelation reaction which accompanies the crosslinking reaction between the molecules, or a reaction initiation point which accelerates the reaction of breakage of the molecular chain (degradation to lower molecular compounds) of the polysiloxane beyond the gelation reaction.

Therefore, in order to prevent aging of the precursor, it is judged preferable that the silicone finish should be one which tends to be rather easily gelated.

For the uniform deposition of a finish on the precursor, a silicone finish must either be dissolved in an organic solvent or used as a fine particle aqueous emulsion. Considering safety and cost, the use of an organic solvent is not industrially expedient, and thus it is normally used as an aqueous emulsion. However, most silicone finishes are generally hydrophobic, making it difficult to obtain a fine particle aqueous emulsion of 0.1 micron or less.

Consequently, in the past polyaminosiloxane has been emulsified in water and emulsions containing acidic groups have been advantageously used therewith to obtain fine particle emulsions of particle size 0.1 micron or less. For example, as described in an Example in Japanese Patent Publication No. 24136/77, a phosphoric acid monoester such as POE(9) nonylphenyl phosphate (also called nonylphenyl phosphate) may be used to properly prepare a salt with the amino group of polyaminosiloxane, considerably improving the hydrophilic properties thereof and almost completely solubilizing it to obtain a transparent aqueous solution, and the average particle size of the emulsion is 0.1 micron or less, and such fine particles cannot be seen with an ordinary microscope. As a result, there is no uneven deposition of the finish and a uniform film may be formed on the surface of the precursor, and therefore a finish with such properties may be advantageously used for the production of precursors for high-performance carbon fibers.

Nevertheless, emulsions with such excellent emulsifiability are those which contain strong acidic groups such as phosphoric acid, sulfuric acid, and the like. In contrast, nonionic emulsifiers such as fatty acid esters, alkyl ethers and the like have inferior emulsifiability, making it impossible to obtain fine particle emulsions of 0.1 micron or less. From the standpoint of aging prevention, nonionic emulsifiers with no strong acidic groups are preferable, but by themselves they do not allow transparent aqueous solution finishes to be obtained.

Here, much diligent research was carried out regarding a method of obtaining a fine particle emulsion with good transparency using polyether and ester-type nonionic emulsifiers containing no strong acidic groups. A wide investigation was made for a finish composition with good emulsifying properties and capable of preventing the aging of the precursor, and thus the present invention has been achieved.

Furthermore, a solution was also found for the problem of a long time required for the mixing of the amino-modified polysiloxane, emulsifier and emulsifying accelerator due to the high viscosity which interferes therewith.

The object of the present invention is to provide a finish composition which prevents the aging of the precursor, forms a fine particle emulsion which is uniformly deposited onto the surface of the precursor, and lowers the viscosity of the aqueous solution finish, as well as a precursor for high-performance carbon fibers onto which the finish composition is deposited.

DETAILED DESCRIPTION OF THE INVENTION

This object is achieved by depositing onto the precursor 0.1–5.0 wt % of a finish composition prepared by mixing (1) 0.2–10 parts by weight of an aminocarboxylic material selected from the group consisting of carboxylic acid salts of alkylamines, carboxylic acid salts of arylamines, carboxylic acid salts of alkylarylamines, amino acids and betaine compounds, and (2) 100 parts by weight of a mixture of (a) 80–20 parts by weight of a finish prepared by adding, to (i) a silicone finish containing 50 wt % or more of an amino-modified polysiloxane having a nitrogen content in amino groups in the range of 0.05–2.0 wt % and a viscosity at 25° C. of 500 centistokes or more, (ii) 0.3–5.0 molar equivalents of an aliphatic monocarboxylic acid of 6 carbon atoms or less with respect to 1 mole of the amino group, and (b) 20–80 parts by weight of a nonionic emulsifier whose main component is a POE alkylaryl ether, a POE alkyl ether or a POE fatty acid ester.

A suitable precursor for use is one which is obtained by dry, wet or dry-wet spinning of an acrylonitrile copolymer containing acrylonitrile in an amount of 90 wt % or more, and preferably 95 wt % or more. Also, a suitable range for the amount of the finish composition according to the present invention which is to be deposited on the precursor to obtain high-performance carbon fibers, is 0.1–5.0 wt %, as the effect is difficult to adequately achieve at less than 0.1 wt % or more than 5.0 wt %.

A suitable amino-modified polysiloxane to be used according to the present invention is one with a nitrogen content in amino groups of 0.05–2.0 wt %, as it is difficult to obtain a fine particle emulsion if the nitrogen content thereof is less than 0.05 wt %. If the nitrogen content is greater than 2.0 wt % then a fine particle emulsion may be readily obtained but stability will be lacking, leading to ready decomposition of the components of the finish upon treatment for oxidation and difficulty in obtaining high-performance carbon fibers.

A high viscosity of the amino-modified polysiloxane of 500 centistokes or greater at 25° C. provides good results, since using one with a lower viscosity than this makes it impossible to obtain high-strength carbon fibers. The maximum viscosity is not particularly restricted, but since too high a viscosity complicates the mixing with the emulsifier, it is conveniently up to 10,000 centistokes; however, if a mixer for high viscosities is used, then a highly viscous polysiloxane may be used, practically eliminating any upper limit on the viscosity.

As the silicone finish used here, an amino-modified polysiloxane is suitable, but there is no problem with mixing therewith a silicone finish such as a polydimethylsiloxane or polymethylphenylsiloxane, or a polyether-modified or epoxy-modified or other-modified polysiloxane, in a range at which the average particle size of the emulsion formed by emulsification in water is not greater than 0.1 micron, and the transparency of a 20 wt % solution is not lower than 60%; however, if the amino-modified polysiloxane is not contained therein in an amount of at least 50 wt %, then it will be difficult to retain the particle size and the transparency of the aqueous solution in a suitable range.

As the emulsifier may be used a nonionic emulsifier including a water-soluble POE alkyl ether, POE alkylaryl ether or POE fatty acid ester, or a mixture thereof, but sufficient emulsification cannot be achieved with this alone. Prior to the emulsification, it is necessary to add to the silicone finish a lower aliphatic monocarboxylic acid of 6 carbon atoms or less in an amount corresponding to 0.3–5.0 molar equivalents with respect to 1 mole of the amino group of the amino-modified polysiloxane. This will accelerate the emulsification while making possible adequate emulsification even with a nonionic emulsifier having no strong acidic group. Here, the lower aliphatic monocarboxylic acid of 6 carbon atoms or less to be added to accelerate the emulsification of the amino-modified polysiloxane may be a monocarboxylic acid such as formic acid, acetic acid, propionic acid, butyric acid, isobutyric acid, valeric acid, isovaleric acid, caproic acid, etc., or a hydroxycarboxylic acid of 4 carbon atoms or less, such as glycolic acid, lactic acid, malonic acid, etc. These monocarboxylic acids may be used either alone or as a mixture of 2 or more thereof.

Monocarboxylic acids of 7 carbon atoms or more cannot be used alone since they do not provide a sufficient effect to accelerate the emulsification, but there is no problem with their use together with carboxylic acids of 6 carbon atoms or less. However, such use is meaningless from an industrial point of view, since they provide essentially no effect of acceleration of the emulsification.

Furthermore, for adequate emulsification of the amino-modified polysiloxane, it is appropriate to add a monocarboxylic acid in an amount of 0.3–5.0 molar equivalents with respect to 1 mole of the amino group, since with addition in an amount lower than this range there will be inadequate emulsification and addition in an amount higher than this range is meaningless since there is no effect on the emulsification.

The mixing ratio of the nonionic emulsifier with the silicone finish containing 50 wt % or more of the amino-modified polysiloxane is most suitably in the range of 80/20–20/80 in terms of weight ratio, since a good emulsion cannot be obtained if the emulsifier is added in an amount lower than this range. Also, adding the emulsifier in an amount higher than this range is meaningless since it does not increase the emulsifying effect.

When the finish composition which is prepared in this manner is diluted with water, an aqueous solution is obtained which is practically transparent with the naked eye, and the particles can barely be seen even with a light microscope. When the particle size of a 20 wt % aqueous solution emulsion prepared in this manner is determined using a light-scattering photometer, the average particle size is usually 0.1 micron or less (10–80 mμ).

Here, if the monocarboxylic acid is added to the silicone finish after the silicone finish is added to the aqueous emulsifier solution and not before, then a fine particle emulsion may not be obtainable. However, since it also depends on the characteristics of the mixer or stirrer used for the emulsification, then the order of addition of the silicone finish, monocarboxylic acid and emulsifier is not necessarily limited; however, when the transmittance of a 20 wt % aqueous solution of the finish composition is measured against purified water in a 1 cm cell at a wavelength of 660 mμ using a spectrophotometer, the emulsification is required to be such as to provide a transmittance (hereunder also referred to as transparency) of 60% or greater. Furthermore, the particle size of the emulsion is also preferred to be 0.1 micron or less, but there is no problem even if it contains some particles which are over 0.1 micron so long as their content is in a range which does not cause the transparency to fall under 60%.

When 0.2–10 parts by weight of an aminocarboxylic material selected from the group consisting of carboxylic acid salts of alkylamines, carboxylic acid salts of arylamines, carboxylic acid salts of alkylarylamines, amino acids and betaine compounds, is added to 100 parts by weight of a composition according to the present invention comprising a silicone finish containing 50 wt % or more of an amino-modified polysiloxane, a lower monocarboxylic acid and a nonionic emulsifier, and the mixture is kneaded, the viscosity of the finish composition lowers thus facilitating the mixing procedure while also greatly reducing the viscosity of the aqueous solution of the finish composition. As a result, the treatment of the precursor with the finish is facilitated, and the finish can be rapidly and evenly deposited on the precursor.

The strand strength of carbon fibers obtained by oxidizing and carbonizing the precursor obtained in this manner is improved over those produced using a finish to which no aminocarboxylic acid has been added. This mechanism has not been fully understood, but since the viscosity of the aqueous finish solution is low, it is assumed that it is due to the reduction in the low-strength single fibers which results from the even deposition of the finish onto the precursor, which is an assembly of single fibers, even to the single fibers located in the interior thereof.

As the aminocarboxylic acid to be used here are included those containing amino groups in the molecule and having a carboxylic acid added thereto in a roughly equivalent molar amount with respect to the amino groups (aminocarboxylic salts) and those having an amino group and a carboxylic acid group in the same molecule (amino acids and betaine compounds); however, those with poor solubilities of 0.2 g or less to 100 g of water may not be used. The compound containing the amino group in the molecule may be any one from primary to quarternary amines, and alkylamines, arylamines or alkylarylamines containing a hydroxy group in addition to an amino group may be used. Also, even if the amino group-containing compounds themselves are poorly soluble in water, those with which a concentration of 0.2 wt % or greater is obtainable by increasing the water solubility by the addition of a carboxylic acid may be used.

The amount of the aminocarboxylic acid to be added will differ depending on its structure, and therefore it is difficult to unconditionally define it, but as mentioned above, normally a range of 0.2–10 parts by weight is appropriate. If it is less than 0.2 parts by weight, then it will be difficult to lower the viscosity of the 20 wt % solution of the finish composition to 10 centistokes or less, while if it is added at greater than 10 parts by weight, then it will be impossible to efficiently lower the viscosity, and thus addition thereof at greater than 10 parts by weight is not very practical.

By adjusting the pH of the finish composition according to the present invention to about 4–9, the stability of the emulsion will be maintained over a long period, and if the pH deviates from this range then the stability of the emulsion will be impaired, and the transparency of the aqueous solution lowered. Therefore, the ratio of the amino group and the carboxylic acid is preferably molar equivalency, although they need not be in molar equivalents if they are in range at which the pH of the aqueous solution can be maintained at 4–9.

Thus, if the aminocarboxylic acid is added in this manner, there is almost no danger of impairing the transparency of the aqueous solution of the finish composition, i.e., the stability of the fine particle emulsion, or of lowering the effect against the aging of the precursor. Not only is there absolutely no acceleration of the aging even when such an aminocarboxylic acid is added, but there is also exhibited an effect of great improvement in the bonding of the finish to the heating roller during the process of producing the precursor. This is also thought to be attributable to the lower viscosity of the finish composition and its aqueous solution.

As described above, a finish which undergoes some degree of gelation during the heating for the prevention of aging is preferred; as a measurement of the degree of gelation, when a finish composition according to the present invention is heated in the air at 230° C. for 60 minutes and then washed with MEK to remove the soluble components and the MEK-insoluble matter determined, the result is 30 wt % or greater, and a method of washing the finish with MEK after heating and measuring the insoluble matter to determine the degree of gelation is described in detail in the Examples.

The aging of the precursor is considerably improved by using an amino-modified polysiloxane finish composition which has been prepared so that the MEK-insoluble matter in the polysiloxane upon heating at 230° C. for 60 minutes is 30 wt % or greater.

On the other hand, with an amino-modified polysiloxane finish composition which is outside the range according to the present invention, for example, a finish prepared by adding 3 wt % of an antioxidant [2,2'-methylenebis-(4-methyl-6-t-butylphenol), trade name: Sumilizer MDP-S] to a 2:1 (weight ratio) mixture of polyaminosiloxane (viscosity: 1500 centistokes, amino group nitrogen content: 0.4%) and a phosphoric acid monoester of POE(9) nonylphenol ether (emulsifier), 10 wt % or less of MEK-insoluble matter was found to be present after heating at 230° C. for 60 minutes, and extremely severe aging of the precursor was also found. This is because, although gelation may be prevented as a result of the addition of the antioxidant, there is absolutely no effect to prevent the aging of the precursor.

In Japanese Patent Kokai (Laid-open) No. 91225/90 there is proposed a method for the prevention of the bonding of finishes to rollers and guides by the addition of various antioxidants, and this method may actually be effective against the bonding of finishes; however, it often causes a reverse effect from the point of view of the necessary effect of prevention of aging of the precursors of high-performance carbon fibers, that is, the ability to maintain a high quality of the precursors.

The reason for this is thought to be that, even if the gelation of polysiloxane can be prevented by the addition of an antioxidant, a portion of the polysiloxane disappears as a result of degradation to lower molecular compounds, impairing the thermal stability of the polysiloxane.

Based on the research carried out by the present inventors, it has been determined that, as a silicone finish used for a precursor of high-performance carbon fibers, it is more preferable to use one which has improved thermal stability by appropriate gelation due to thermal treatment of such a level as in a step of oxidation.

In addition, by the choice of appropriate constituents and viscosity of the aqueous solution of the finish composition, it is possible to greatly improve the bonding of the finish to rollers and guides for the efficient production of precursors and carbon fibers.

EXAMPLES

Representative Examples are provided below for a more concrete description of the present invention, but the present invention is in no way limited to these Examples. Unless otherwise specified, "%" and "part" used in the Examples refer to weight.

The contents of the precursors and oxidized fibers of polysiloxane (silicone finish) and the evaluations of the particle size of the emulsions, transparency of the solutions, MEK-insoluble matter and aging were determined by the following methods.

(1) Method of measuring polysiloxane content

A sample (precursor or oxidized fibers) is alkali-fused with potassium hydroxide/sodium burylate and then dissolved in water, and the pH is adjusted to 1 with hydrochloric acid. To this is added sodium sulfite and ammonium molybdenate for color development, colorimetry (wavelength: 815 mμ) is carried out with silica molybdenum blue to determine the silicon content. Using the value of this silicon content and the silicon content of crude polysiloxane determined in advance by the same method, the polysiloxane content of the sample is calculated.

(2) Measurement of the particle size of emulsion

The average particle size and the particle distribution of a 20 wt % aqueous solution of the finish composition was determined using a Dynamic light-scattering photometer, product of Otsuka Denshi Co.

(3) Measurement of transparency of finish solution

A 20wt % aqueous solution of the finish composition was placed on a 1 cm cell, and the measurement of the transmittance through purified water was carried out at a wavelength of 660 mμ. The photometer used was a Spectrophotometer Model 100-10, product of Hitachi Seisakusho.

(4) Measurement of MEK-insoluble matter

An approximately 5 g portion of a 20 wt % aqueous solution of the finish composition is poured onto a 6 cm-diameter aluminum pan of known weight (depth: 1.5 cm), and this is dried for one hour in a drying oven at 105° C. and then the weight thereof (weight: A grams) is measured. Since the finish composition contains emulsifiers, carboxylic acids, aminocarboxylic acids and the like in addition to the polysiloxane (silicone oil), their weight is also included in the weight (weight: A grams) after drying for one hour at 105° C. Consequently, the weight of the polysiloxane alone is the weight of the dry solid matter (weight of A—aluminum pan) in grams multiplied by the weight ratio of the polysiloxane in the finish composition. This is A' grams. The weight ratio is calculated from the mixing ratio of the polysiloxane, emulsifier, carboxylic acid and aminocarboxylic acid. The mixture is placed in a drying oven at 230° C. and heated for one hour. The heated finish is transferred to a beaker using 50 ml of MEK, and the mixture is stirred at room temperature for 5 minutes and filtered using a glass filter of known weight. The filter cake is then washed twice with 50 ml of MEK to remove the MEK-soluble matter, and then dried in a drying oven at 105° C. for 30 minutes and the weight thereof measured (Weight:

B grams). Even upon heating at 230° C. for 1 hour, the emulsifier and the carboxylic acid and aminocarboxylic acid dissolve in the MEK, and therefore after the washing with MEK the mixture is gelated and only the insolubilized polysiloxane remains on the glass filter.

Accordingly, the MEK-insoluble matter is described by the following equation.

$$MEK \text{ insoluble matter} = \frac{B \text{ grams} - \text{gram weight of glass filter}}{A' \text{ grams}}$$

A' grams=(A—aluminum pan) g×mixing weight ratio of polysiloxane in finish composition (5) Method for evaluation of precursor aging The freshly prepared precursor is allowed to stand in an oxidation oven with air circulation at 220° C., 230° C. and 240° C., for 20 minutes at each temperature for oxidation, and then in a carbonization furnace at maximum temperatures of 500° C., 1000° C. and 1400° C. for continuous carbonization. The resultant carbon fibers are measured for strand strength (Strength A) according to the JIS-R-7601 method. As the resin solution was used a mixture solution of Epikote #828/3 monoethylamine borofluoride/methyl ethyl ketone=100/3/30 (weight ratio).

On the other hand, measurement was made in the same manner of the strand strength (Strength B) of carbon fibers obtained by preserving the same precursor for 3 months in an air circulation bath at 60° C., and then subjecting it to oxidation and carbonization in the same manner.

Strength retention after aging=B/A×100 (%)

Example 1

A copolymer consisting of 98% acrylonitrile and 2% methacrylic acid was spun, and precursors of 12,000 filaments (single filament denier—0.6 d) obtained by depositing finish compositions thereon were allowed to stand in an oxidation oven with air circulation at 220° C., 230° C. and 240° C., for 20 minutes at each temperature for oxidation, and then in a carbonization furnace at maximum temperatures of 500° C., 1000° C. and 1400° C. for continuous carbonization.

As shown in Table 1 below, finish compositions 1–4 having different compositions were deposited onto the precursor which was then preserved at normal temperature (20°– 30° C.), 40° C. and 60° C. for 0–12 months for oxidation and carbonization. The preservation times of the precursors and the physical properties of the resulting carbon fibers are shown in Table 1.

The polysiloxane contents of the precursors on which finish compositions 1, 2, 3 and 4 were used were 1.25%, 1.20%, 1.23% and 1.21%, respectively.

As is clear from these results, there was a large difference between the finish compositions 3 and 4 according to the present invention and Comparison 1, and there was considerable aging of the precursor with the finish composition according to Comparison 1, and although exhibiting high performance when freshly prepared, the precursor did not stand up to long-term preservation.

Using the finish compositions 1–4, the oxidized fibers which had been kept at normal temperature for 12 months after production were subjected to extraction with a Soxhelet extractor using MEK as the solvent, and the polysiloxane contents of the oxidized fibers were measured before and after the extraction. The results are shown in Table 2. The precursor on which finish composition 1 was used showed a notable decrease in the polysiloxane even during the step of oxidation, but upon MEK extraction even more of the polysiloxane was eliminated. On the other hand, with finish compositions 3 and 4 according to the present invention, there was little evaporation during oxidation, and even upon MEK extraction 80% or more of the polysiloxane deposited on the oxidized fibers remained without dissolving in the MEK.

It is thought that this is due to the fact that in the case of the finish composition according to Comparison 1, under such high temperatures as required for oxidation, the reaction of degradation to lower molecular compounds predominates over the gelation of the polysiloxane.

The finish composition according to Comparison 2 also had a large amount of MEK-insoluble matter, with almost no aging, but compared with finish compositions 3 and 4 according to the present invention, the viscosity of the 20% aqueous solution thereof was high and the strength of the carbon fibers was lower. The kneading of this finish composition 2 with the polysiloxane, emulsifier and lactic acid added thereto, because of the high viscosity, required 3 times the amount of time in comparison with the kneading of finish compositions 3 and 4. Furthermore, the amount of the finish bonded onto the drying roller at 120°–150° C. during the production of the precursor in the case of finish composition 2 was about 10 times greater than in the cases of the finish compositions 3 and 4.

Example 2

Precursors were prepared and oxidized and carbonized in the same manner as in Example 1, except for changing the compositions of the amino-modified polysiloxane finish, the emulsifier used for its emulsion and the carboxylic acid and the aminocarboxylic acid used to lower the viscosity. However, the precursors were preserved at 60° C. for 3 months, and the characteristics of the carbon fibers obtained from the precursors before and after the preservation were compared and are shown in Table 3.

As is clear from Table 3, the precursors which contained emulsifiers having strong acidic groups such as phosphoric acid esters, sulfonic acid esters and sulfuric acid esters had less MEK-insoluble matter and their aging was severe, and therefore there was a great reduction in the strength of the carbon fibers resulting after 3 months at 60° C. (finish compositions 14–17). Also, even with the addition of an antioxidant, not only was there no effect on the aging, but it was judged that there was a tendency towards acceleration of the aging (finish compositions 19, 21). On the other hand, with the finish compositions having no strong acidic groups except for the carboxylic acid according to the present invention, there was only a very slight rate of tensile strength diminution of the carbon fibers even under hard conditions of 3 months at 60° C. (finish compositions 5–11), and these precursors showed essentially no aging even after 1 year at normal temperature.

As may be seen from the results of the finish compositions 5–11 according to the present invention and the finish compositions 18–21 according to the Comparisons, even with mixing of only a slight amount of 10–20% of an emulsifier having a strong acidic groups with an emulsifier having no strong acidic groups, the aging was considerably accelerated, and thus it was proven that strong acidic groups have a reverse effect on aging.

On the other hand, the finish compositions 12 and 13 contained no strong acidic groups, and thus showed an effect against aging, but compared with the finish compositions according to the present invention, the viscosities of the aqueous solutions were high, and the strength levels of the carbon fibers were low.

Example 3

Precursors prepared in the same manner as in Example 1, except that the finish compositions used were prepared by adding 4.5 parts of dibutylethanolamine acetate to 100 parts of a finish prepared by adding 20 parts of POE(9) nonylphenol ether and lactic acid in the same molar amount as the amino groups to 80 parts of amino-modified polysiloxanes with different nitrogen contents in amino groups (0.03–2.5%), were oxidized and carbonized in the same manner as in Example 1 to obtain carbon fibers. The viscosity at 25° C. of each of the amino-modified polysiloxanes used here was in a range of 1300–15000 centistokes, and the amount of the amino-modified polysiloxane deposited onto the precursors was 1.0–1.2%.

The transparency of the 20% aqueous solutions of the finish compositions and the strengths of the resulting carbon fibers are shown in Table 4. As is clear from these results, when amino-modified polysiloxanes are used whose nitrogen contents in amino groups exceeds 2% or are under 0.05%, high-strength carbon fibers cannot be obtained. In addition, when the nitrogen content thereof is under 0.05%, an aqueous solution with good transparency can not be obtained.

Example 4

A copolymer consisting of 98% acrylonitrile and 2% methacrylic acid was spun, and precursors of 6,000 filaments (single filament denier—0.8 d) obtained by depositing finish compositions which were prepared by adding 30 parts of POE(9) lauryl ether, 3 parts of acetic acid and 4.5 parts of dibutylethanolamine acetate to 70 parts of an amino-modified polysiloxane which had nitrogen contents in amino groups of 0.3–0.5% and viscosities at 25° of 150–47820 centistokes, were oxidized and carbonized in the same manner as in Example 1 to obtain carbon fibers. The amounts of the amino-modified polysiloxanes deposited on the precursors were in the range of 1.0–1.2%.

The strengths of these carbon fibers are shown in Table 5. The transparencies of the 20% aqueous solutions of the finish compositions used here were all in the range of 90–95%.

The fibers with a low viscosity of the amino-modified polysiloxane exhibited mutual fusion of the single filaments during the oxidation process, and consequently they were considerably embrittled during the carbonization process and broke, making it impossible to obtain satisfactory carbon fibers. It became clear that amino-modified polysiloxanes with a viscosities of 500 centistokes or greater provided a favorable effect.

Example 5

The transparencies of 20% aqueous solutions of finish compositions prepared by changing the types and amounts of the monocarboxylic acid added to a mixture of 80 parts of an amino-modified polysiloxane with a nitrogen content in amino groups of 0.5% and a viscosity at 25° C. of 1700 centistokes and 20 parts of POE(9) nonylphenol ether, were measured and are shown in Table 6.

The amount of the dibutylethanolamine acetate added to lower the viscosity of each of the finish compositions was constant at 4.5 parts.

With pelargonic acid and lauric acid which have 7 carbon atoms or more and dicarboxylic acids, there is no effect of acceleration of the emulsification, and when the molar ratio of the monocarboxylic acid to the amino-modified polysiloxane is less than 0.3:1, the emulsification is extremely reduced. Also, even when the carboxylic acid is added in an amount of moles or greater to 1 mole of the amine, there is no improvement in the emulsification, and thus such addition is meaningless.

Example 6

The transparencies of 20% aqueous solutions of finish compositions prepared by changing the proportions of an amino-modified polysiloxane with a nitrogen content in amino groups of 0.4% and a viscosity at 25° C. of 1500 centistokes and POE(9) nonylphenol ether (emulsifier) from 10/90 to 90/10, and further adding to 100 parts of these mixtures lactic acid in the same molar amount as the amine in the amino-modified polysiloxane and mixing 4.5 parts of dibutylethanolamine acetate therewith, were measured and are shown in Table 7.

The proportions of the amino-modified polysiloxanes and the emulsifier which were in the range of 80/20–20/80 were most favorable, and with less of the emulsifier it is impossible to obtain a solution of the finish composition with a good transparency even by adding a monocarboxylic acid thereto. On the other hand, even when the emulsifier is added in amount greater than this range, there is no improvement in the transparency, and thus such addition is meaningless.

Example 7

Precursors prepared in the same manner as in Example 1 except that the finish compositions prepared by combining 80 parts of an amino-modified polysiloxane with a nitrogen content in amino groups of 0.4% and a viscosity at 25° C. of 1700 centistokes, 20 parts of POE(9) nonylphenol ether, 2 parts of acetic acid and 3 parts of aniline acetate were deposited in amounts of 0.05–6.0%, were oxidized and carbonized to obtain carbon fibers. The strengths of the carbon fibers are shown in Table 8.

The amounts of the finish compositions deposited on the precursors were calculated by extraction of the precursors for 1 hour with MEK using a Soxhelet extractor, and evaporating the extract solution to solid, and the values were roughly the same as of the finish compositions calculated from the amounts of the amino-modified polysiloxanes determined by the above mentioned colorimetry of the precursors and the mixing ratios of the amino-modified polysiloxanes in the finish composition.

In cases where the amount of the finish composition deposited on the precursor was not at least 0.1%, there was mutual fusion of the single filaments during the oxidation process, and consequently there was severe embrittlement during carbonization, and the filaments broke in the furnace making it impossible to obtain satisfactory carbon fibers. In addition, even when the finish composition was deposited in an amount of 5% or greater, there was no effect, and in fact there was a tendency towards reduction of the strength of the carbon fibers. As a result, an appropriate range of the finish composition to be deposited on the precursor is 0.1–5.0%, and more preferably 0.5–2.5%.

Example 8

In order to investigate regarding finishes comprising a mixtures of an amino-modified polysiloxane and another polysiloxane, finish compositions 22–28 were prepared, their transparency and MEK-insoluble matter thereof were measured, and the results are shown in Table 9. It was found that in order to retain the characteristics in the ranges according to the present invention, i.e. a transparency of 60% or greater and an MEK-insoluble matter of 30% or greater of the 20% aqueous solution of the finish composition, the ratio of the amino-modified polysiloxane in the silicone finish must be at least 50% or greater. With the finishes which contained the amino-modified polysiloxane in an amount less than the polydimethylsiloxane, fine particle emulsions could not be obtained, and therefore the transparencies of the aqueous solutions were low and there was less MEK-insoluble matter, making them unsuitable as precursor finishes for high-strength carbon fibers. On the other hand, since ether-modified polysiloxanes themselves are water-soluble, their mixture solutions with amino-modified polysiloxanes have high degrees of transparency but less MEK-insoluble matter. It became clear that when ether-modified polysiloxanes themselves are heated at 230° C. for 1 hour, they undergo about 75% evaporation and thus lack thermal stability.

Example 9

Precursors were prepared in the same manner as in Example 4 except that the 7 types of finishes in Example 8 were used, and were oxidized and carbonized in the same manner as in Example 1 to obtain carbon fibers. Also, these precursors were preserved at 60° C. for 3 months, and the aged precursors were oxidized and carbonized again under the same conditions and the strength retentions thereof were calculated. These results are shown in Table 10.

In the cases where finishes containing a large amount of the polysiloxane or ether-modified polysiloxane were used, not only were high-strength carbon fibers unobtainable, but their strength retentions were clearly lower, and thus the ratio of the amino-modified polysiloxane must be at least 50% or greater.

TABLE 1

Tensile modulus (t/mm$^2$) and strength (kg/mm$^2$) of carbon fibers

| Name of finish | Finish 1 (Comparison) Tensile modulus/ strength | Finish 2 (Comparison) Tensile modulus/ strength | Finish 3 (Present invention) Tensile modulus/ strength | Finish 4 (Present invention) Tensile modulus/ strength |
|---|---|---|---|---|
| Freshly prepared (within 7 days) | 31.2/674 | 31.5/677 | 31.6/723 | 31.5/715 |
| Normal temperature 6 months | 31.1/635 | 31.5/675 | 31.5/717 | 31.4/713 |
| Normal temperature 12 months | 30.6/585 | 31.4/676 | 31.5/720 | 31.5/712 |
| 40° C. 3 months | 30.9/592 | 31.3/672 | 31.4/718 | 31.4/710 |
| 40° C. 6 months | 29.8/530 | 31.2/665 | 31.4/711 | 31.3/713 |
| 60° C. 1 month | 30.6/575 | 31.4/675 | 31.5/718 | 31.3/714 |
| 60° C. 3 months | 30.2/527 | 31.3/658 | 31.3/713 | 31.3/707 |

Name and composition of finishes

Finish 1 (Comparison):

2:1 mixture of polyaminosiloxane (viscosity: 1500 cs, nitrogen content: 0.4%)/POE(9) nonylphenol phosphate Transparency of 20% aqueous solution: 98%

Viscosity of 20% aqueous solution: 2.6 cst

MEK-insoluble matter: 6.5%

Average particle size: 19.5 mμ, maximum particle size: 44 mμ

Finish 2 (Comparison)

Finish composition prepared by adding 3 parts of lactic acid to 100 parts of a 2/1 mixture of polyaminosiloxane (viscosity: 1500 cs, nitrogen content: 0.4%)/POE(9) nonylphenol ether.

Transparency of 20% aqueous solution: 96%

Viscosity of 20% aqueous solution: 28.5 cst

MEK-insoluble matter: 85.6%

Average particle size: 20.2 mμ, maximum particle size: 92 mμ

Finish 3 (Present invention)

Finish composition prepared by adding 1.5 parts of aminoethylethanol acetate to a mixture consisting of 3 parts of lactic acid added to 100 parts of a 2:1 mixture of polyaminosiloxane (viscosity: 1500 cs, nitrogen content: 0.4%)/POE (9) nonylphenol ether.

Transparency of 20% aqueous solution: 93%

Viscosity of 20% aqueous solution: 2.7 cst

MEK-insoluble matter: 83.0%

Average particle size: 23.8 mμ, maximum particle size: 85 mμ

Finish 4 (Present invention)

Finish composition prepared by adding 4.5 parts of dibutylethanolamine acetate to a mixture consisting of 2 parts of lactic acid and 3 parts of an antioxidant (tradename ADEKASTAB AO-23, product of Adeka Augas Co.) added to 100 parts of a 2:1 mixture of polyaminosiloxane (viscosity: 1500 cs, nitrogen content: 0.4%)/POE(9) nonylphenol ether.

Transparency of 20% aqueous solution: 93%

Viscosity of 20% aqueous solution: 2.6 cst

MEK-insoluble matter: 80.1%

Average particle size: 25.5 mμ, maximum particle size: 82 mμ

TABLE 2

Polyaminosiloxane Content

| | Finish 1 | Finish 2 | Finish 3 | Finish 4 |
|---|---|---|---|---|
| Precursor | 1.25 | 1.20 | 1.23 | 1.21 |
| Oxidized fibers (prior to extraction with MEK) | 0.75 | 1.16 | 1.18 | 1.14 |
| Oxidized fibers (after extraction with MEK) | 0.27 | 1.00 | 1.05 | 0.92 |

TABLE 3

| Name of finish | Transparency (%) | Viscosity (cst) | MEK-insoluble matter (%) | Carbon filament strength ($kg/mm^2$) Freshly prepared | After 3 months at 60° C. | Strength retention (%) |
|---|---|---|---|---|---|---|
| 5 (Present invention) | 94 | 2.6 | 67 | 714 | 708 | 99 |
| 6 (Present invention) | 94 | 3.5 | 68 | 710 | 702 | 99 |
| 7 (Present invention) | 93 | 5.3 | 70 | 708 | 696 | 98 |
| 8 (Present invention) | 92 | 3.7 | 72 | 703 | 688 | 98 |
| 9 (Present invention) | 96 | 6.3 | 70 | 706 | 681 | 96 |
| 10 (Present invention) | 95 | 8.4 | 75 | 712 | 698 | 98 |
| 11 (Present invention) | 94 | 9.7 | 65 | 706 | 672 | 95 |
| 12 (Comparison) | 94 | 28.0 | 64 | 675 | 648 | 96 |
| 13 (Comparison) | 92 | 29.5 | 88 | 664 | 657 | 99 |
| 14 (Comparison) | 95 | 2.5 | 8 | 661 | 495 | 75 |
| 15 (Comparison) | 93 | 3.2 | 5 | 643 | 501 | 78 |
| 16 (Comparison) | 91 | 3.5 | 7 | 633 | 515 | 81 |
| 17 (Comparison) | 88 | 3.0 | 10 | 643 | 530 | 82 |
| 18 (Comparison) | 92 | 2.8 | 22 | 638 | 555 | 87 |
| 19 (Comparison) | 90 | 3.4 | 15 | 659 | 561 | 85 |
| 20 (Comparison) | 96 | 3.6 | 28 | 653 | 575 | 88 |
| 21 (Comparison) | 93 | 3.8 | 19 | 642 | 553 | 86 |

Name and composition of finishes

Finish 5 (Present invention)

Finish composition prepared by adding 4.5 parts of dibutylethanolamine acetate to 102 parts of a 70/30/2 mixture of polyaminosiloxane (viscosity: 1700 cs, nitrogen content: 0.6%)/POE(9) nonylphenol ether/acetic acid.

Finish 6 (Present invention)

Finish composition prepared by adding 3 parts of aniline acetate to 102 parts of a 70/30/2 mixture of polyaminosiloxane (viscosity: 1700 cs, nitrogen content: 0.6%)/POE(9) nonylphenol ether/acetic acid.

Finish 7 (Present invention)

Finish composition prepared by adding 5 parts of β-alanine acetate to 102 parts of a 70/30/2 mixture of polyaminosiloxane (viscosity: 1700 cs, nitrogen content: 0.6%)/POE(9) nonylphenol ether/acetic acid.

Finish 8 (Present invention)

Finish composition prepared by adding 3 parts of POE(4) octylamine acetate to 103 parts of a 70/30/3 mixture of polyaminosiloxane (viscosity: 1700 cs, nitrogen content: 0.6%)/POE(9) nonylphenol ether/acetic acid.

Finish 9 (Present invention)

Finish composition prepared by adding 6 parts of POE (10) laurylamine acetate to 103 parts of a 70/15/15/3 mixture of polyaminosiloxane (viscosity: 1700 cs, nitrogen content: 0.6%)/POE(9) nonylphenol ether/POE(9) sec-alkyl (mixture of 12–14 carbon atom alkyls) ether/lactic acid.

Finish 10 (Present invention)

Finish composition prepared by adding 8 parts of triethyloctylamine acetate to 102 parts of a 60/40/2 mixture of polyaminosiloxane (viscosity: 1700 cs, nitrogen content: 0.6%)/POE(5) octyl ether/lactic acid.

Finish 11 (Present invention)

Finish composition prepared by adding 7 parts of diethyloleilimidazole formate to 103 parts of a 67/33/3 mixture of polyaminosiloxane (viscosity: 1700 cs, nitrogen content: 0.6%)/POE(8) laurate/acetic acid.

Finish 12 (Comparison)

A 70/30/3 mixture of polyaminosiloxane (viscosity: 1700 cs, nitrogen content: 0.6%)/POE(7) nonylphenol ether/acetic acid.

Finish 13 (Comparison)

A 60/40/3 mixture of polyaminosiloxane (viscosity: 1700 cs, nitrogen content: 0.6%)/POE(5) octyl ether/lactic acid.

Finish 14 (Comparison)

A 70/30 mixture of polyaminosiloxane (viscosity: 1700 cs, nitrogen content: 0.6%)/POE(9) nonylphenol phosphate.

Finish 15 (Comparison)

A 80/20 mixture of polyaminosiloxane (viscosity: 1700 cs, nitrogen content: 0.6%)/POE(9) nonylphenol sulfonate.

Finish 16 (Comparison)

A 60/40 mixture of polyaminosiloxane (viscosity: 1700 cs, nitrogen content: 0.6%)/POE(5) octyl sulfate.

Finish 17 (Comparison)

A 70/30 mixture of polyaminosiloxane (viscosity: 1700 cs, nitrogen content: 0.6%)/POE(9) sec-alkyl (mixture of 12–14 carbon atom alkyls) phosphate.

Finish 18 (Comparison)

A 60/32/8/2 mixture of polyaminosiloxane (viscosity: 1700 cs, nitrogen content: 0.6%)/POE(9) nonylphenol ether/POE nonylphenol phosphate/acetic acid.

Finish 19 (Comparison)

Prepared by adding 2 parts of an antioxidant (Sumilizer MDP-S, product of Sumitomo Kagaku) to 102 parts of a 60/32/8/2 mixture of polyaminosiloxane (viscosity: 1700 cs, nitrogen content: 0.6%)/POE(9) nonylphenol ether/POE nonylphenol phosphate/acetic acid.

Finish 20 (Comparison)

A 60/36/4/3 mixture of polyaminosiloxane (viscosity: 1700 cs, nitrogen content: 0.6%)/POE(9) nonylphenol ether/POE nonylphenol phosphate/lactic acid.

Finish 21 (Comparison)

Prepared by adding 3 parts of an antioxidant (Sumilizer MDP-S, product of Sumitomo Kagaku) to 103 parts of a 60/36/4/3 mixture of polyaminosiloxane (viscosity: 1700 cs, nitrogen content: 0.6%)/POE(9) nonylphenol ether/POE nonylphenol phosphate/lactic acid.

TABLE 4

| | | | | | | | | | |
|---|---|---|---|---|---|---|---|---|---|
| Nitrogen % | 2.5 | 2.0 | 1.5 | 0.8 | 0.4 | 0.2 | 0.1 | 0.05 | 0.03 |
| Transparency % | 96 | 97 | 97 | 96 | 97 | 95 | 83 | 60 | 20 |
| Carbon fiber strength (kg/mm$^2$) | 585 | 645 | 676 | 707 | 715 | 688 | 653 | 621 | 590 |

TABLE 5

| | | | | | | | | |
|---|---|---|---|---|---|---|---|---|
| Viscosity (cs) | 150 | 500 | 1000 | 1500 | 3000 | 5810 | 13910 | 47820 |
| Carbon fiber strength (kg/mm$^2$) | Breaking upon carbonization | 555 | 608 | 616 | 623 | 612 | 619 | 602 |

TABLE 6

| | Molar ratio of acid/amine | | | | | | |
|---|---|---|---|---|---|---|---|
| | 0.1/1 | 0.3/1 | 0.5/1 | 1/1 | 2/1 | 5/1 | 8/1 |
| Present Invention | | | | | | | |
| Acetic acid | 5 or less | 62 | 92 | 94 | 95 | 96 | 96 |
| Lactic acid | | 60 | 70 | 93 | 94 | 94 | |
| Formic acid | | | 92 | 96 | 96 | | |
| Malonic acid | | | 90 | 92 | 92 | | |
| Comparison | | | | | | | |
| Oxalic acid | | | | 5 or less | | | |
| Succinic acid | | | | 5 or less | | | |
| Pelargonic acid | | | | 5 or less | | | |
| Lauric acid | | | | 5 or less | | | |

TABLE 7

| | | | | | | |
|---|---|---|---|---|---|---|
| Proportion of amino-modified polysiloxane/emulsifier | 90/10 | 80/20 | 67/33 | 50/50 | 20/80 | 10/90 |
| Transparency (%) | 30 | 85 | 92 | 95 | 96 | 96 |

TABLE 8

| | | | | | | | | |
|---|---|---|---|---|---|---|---|---|
| Finish content % | 0.05 | 0.10 | 0.50 | 1.0 | 1.5 | 2.5 | 5.0 | 6.0 |
| Carbon fiber strength (kg/mm$^2$) | Breaking upon carbonization | 645 | 703 | 725 | 716 | 712 | 687 | 662 |

TABLE 9

| Name of finish | Finish 22 | Finish 23 | Finish 24 | Finish 25 | Finish 26 | Finish 27 | Finish 28 |
|---|---|---|---|---|---|---|---|
| Transparency (%) | 90 | 72 | 60 | 32 | 85 | 84 | 83 |
| MEK-insoluble matter (%) | 55 | 37 | 31 | 23 | 43 | 37 | 24 |

Name and composition of finishes

The following components were used in the Examples.

Amino-modified polysiloxane—viscosity: 1700 centistokes, nitrogen content in amino groups: 0.4%

Polydimethylsiloxane—viscosity: 40,000 centistokes

Ether-modified polysiloxane—viscosity: 4000 centistokes, proportion of POE about 50%, water-soluble.

Emulsifier—POE(9) nonylphenol ether

Aminocarboxylic acid: Dibutylethanolamine acetate added to all of the finishes.

Finish 22 (Present invention)

A 60/10/30/2/4.5 mixture of amino-modified polysiloxane/polydimethylsiloxane/emulsifier/acetic acid/aminocarboxylic acid.

Finish 23 (Present invention)

A 40/30/30/2/4.5 mixture of amino-modified polysiloxane/polydimethylsiloxane/emulsifier/acetic acid/aminocarboxylic acid.

Finish 24 (Present invention)

A 35/35/30/2/4.5 mixture of amino-modified polysiloxane/polydimethylsiloxane/emulsifier/acetic acid/aminocarboxylic acid.

Finish 25 (Comparison)

A 25/45/30/2/4.5 mixture of amino-modified polysiloxane/polydimethylsiloxane/emulsifier/acetic acid/aminocarboxylic acid.

Finish 26 (Present invention)

A 50/20/30/2/4.5 mixture of amino-modified polysiloxane/ether-modified polysiloxane/emulsifier/acetic acid/aminocarboxylic acid.

Finish 27 (Present invention)

A 35/35/30/2/4.5 mixture of amino-modified polysiloxane/ether-modified polysiloxane/emulsifier/acetic acid/aminocarboxylic acid.

Finish 28 (Comparison)

A 25/45/30/2/4.5 mixture of amino-modified polysiloxane/ether-modified polysiloxane/emulsifier/acetic acid/aminocarboxylic acid.

TABLE 10

| Name of finish | Finish 22 | Finish 23 | Finish 24 | Finish 25 | Finish 26 | Finish 27 | Finish 28 |
|---|---|---|---|---|---|---|---|
| Carbon fiber strength (kg/mm$^2$) | 605 | 583 | 545 | 476 | 587 | 562 | 525 |
| Strength retention (%) | 95 | 92 | 90 | 82 | 92 | 90 | 81 |

As mentioned above, according to the present invention the industrial production of precursors for high-performance carbon fibers is made easily possible by using as essential components thereof an amino-modified polysiloxane with a specific composition, a nonionic emulsifier with no strong acidic groups, a monocarboxylic acid and an aminocarboxylic acid, to raise the transparency and lower the viscosity of the aqueous solution of the finish composition while preventing the aging of the precursor during its preservation.

Furthermore, even when a precursor on which a finish composition according to the present invention has been deposited is preserved for a long period of time, its characteristics are retained, which is very significant in that the industrial production of high-performance carbon fibers obtained by oxidizing and carbonizing the precursor is not affected by the production schedule for the precursor, and therefore their production may be readily carried out at any time.

In addition, the low viscosity of the finish composition not only facilitates the preparing of the finish composition, but also reduces soiling of the drying roller during the production of the precursor, which makes industrial production of the precursor more efficient, and since the low viscosity finish composition may be easily and evenly deposited onto the precursor, higher-strength carbon fibers may be obtained.

What is claimed is:

1. A finish composition for a precursor for high-performance carbon fibers, said composition comprising (1) 0.2–10 parts by weight of a viscosity lowering agent consisting essentially of an aminocarboxylic material selected from the group consisting of carboxylic acid salts of alkylamines, carboxylic acid salts of arylamines, carboxylic acid salts of alkylarylamines, amino acids and betaine compounds, and (2) 100 parts by weight of a mixture of (a) 80–20 parts by weight of a finish prepared by adding, to (i) a silicone finish containing 50 wt % or more of an amino-modified polysiloxane having a nitrogen content in amino groups in the range of 0.05–2.0 wt % and a viscosity at 25° C. of 500 centistokes or more, (ii) 0.3–5.0 molar equivalents of a lower aliphatic monocarboxylic acid of 6 carbon atoms or less with respect to 1 mole of the amino group, and (b) 20–80 parts by weight of a nonionic emulsifier consisting mainly of a polyoxyethylene alkyl ether, a polyoxyethylene alkylaryl ether or a polyoxyethylene fatty acid ester.

2. The finish composition according to claim 1, wherein the transparency of a 20 wt % aqueous solution of the finish composition is 60% or greater.

3. The finish composition according to claim 1, wherein the insoluble matter of the polysiloxane, determined by heating the finish composition in the air at 230° C. for 60 minutes and then washing it with methyl ethyl ketone, is 30 wt % or greater.

4. A precursor of a high-performance carbon fiber, said precursor comprising:

a fiber comprising at least 90 wt % acrylonitrile; and a coating of a finish composition according to claim 1, said finish composition deposited on said fiber in an amount equivalent to 0.1–5wt % of said precursor.

5. A method for making a precursor of a high-performance carbon fiber, said method comprising the step of treating a fiber comprising at least 90 wt % acrylonitrile with a sufficient amount of a finish composition according to claim 1 to deposit from 0.1–5.0 wt % of said finish composition on said fiber.

6. A method for making a high-performance carbon fiber comprising the steps of oxidizing and carbonizing the precursor set forth in claim 1.

7. A high-performance carbon fiber made according to the method set forth in claim 6.

* * * * *